United States Patent [19]

Sherwood

[11] Patent Number: 4,541,865

[45] Date of Patent: Sep. 17, 1985

[54] CONTINUOUS VACUUM DEGASSING AND CASTING OF STEEL

[76] Inventor: William L. Sherwood, 553 Granville St., 5th Floor, Vancouver, B.C. Canada V6C1Y6

[21] Appl. No.: 610,884

[22] Filed: May 16, 1984

[51] Int. Cl.[4] ..... B22D 19/00; C21C 7/00

[52] U.S. Cl. ..... 75/46; 75/49; 164/459

[58] Field of Search ..... 75/46, 49; 164/459–463

[56] References Cited

U.S. PATENT DOCUMENTS

| | | | |
|---|---|---|---|
| 3,467,167 | 9/1969 | Mahin | 75/49 |
| 3,650,517 | 3/1972 | Messing | 75/49 |
| 4,105,438 | 8/1978 | Sherwood | 75/46 |
| 4,456,476 | 6/1984 | Sherwood | 75/49 |

*Primary Examiner*—Peter D. Rosenberg

[57] ABSTRACT

The invention provides an improved system for continuous processing of molten steel and other metals comprising continuous withdrawal, vacuum treatment and casting, employing a specialized post-treatment vessel stationed adjacent to a continually maintained supply of metal in a furnace bath. The post-treatment vessel incorporates a vacuum degassing column chamber section which is fed with metal through a withdrawal tube with the inlet inserted into the furnace bath and the outlet into the degassing column, the lower portion of which extends laterally into a tundish pouring section from which metal is poured through a nozzle directly into a continuous caster. Sealing of the continuous casting tundish cover, which is incorporated into the post-treatment vessel assembly, is a key element of the invention. Firstly, this provides for initial post-treatment vessel evacuation to start metal withdrawal, simply by sealing off the tundish nozzle (optionally together with a withdrawal tube valve), eliminating secondary starting gates, seals, or the like for the degassing column section. Secondly, it provides a metal flow path from furnace-to-mold completely excluded from the atmosphere. Thirdly, it practically eliminates the influence of intermediate flow restrictions and control points between bath and molds, the overall rate of metal flow being self adjusting throughout, according to withdrawal rate of the solidified casting, which is subject to direct external operator control. Fourthly, by excluding the atmosphere from furnace through to mold, the invention eliminates the well-know deleterious effects of oxygen and nitrogen contact with the molten steel.

20 Claims, 2 Drawing Figures

CONTINUOUS VACUUM DEGASSING AND CASTING OF STEEL

Figure 1:
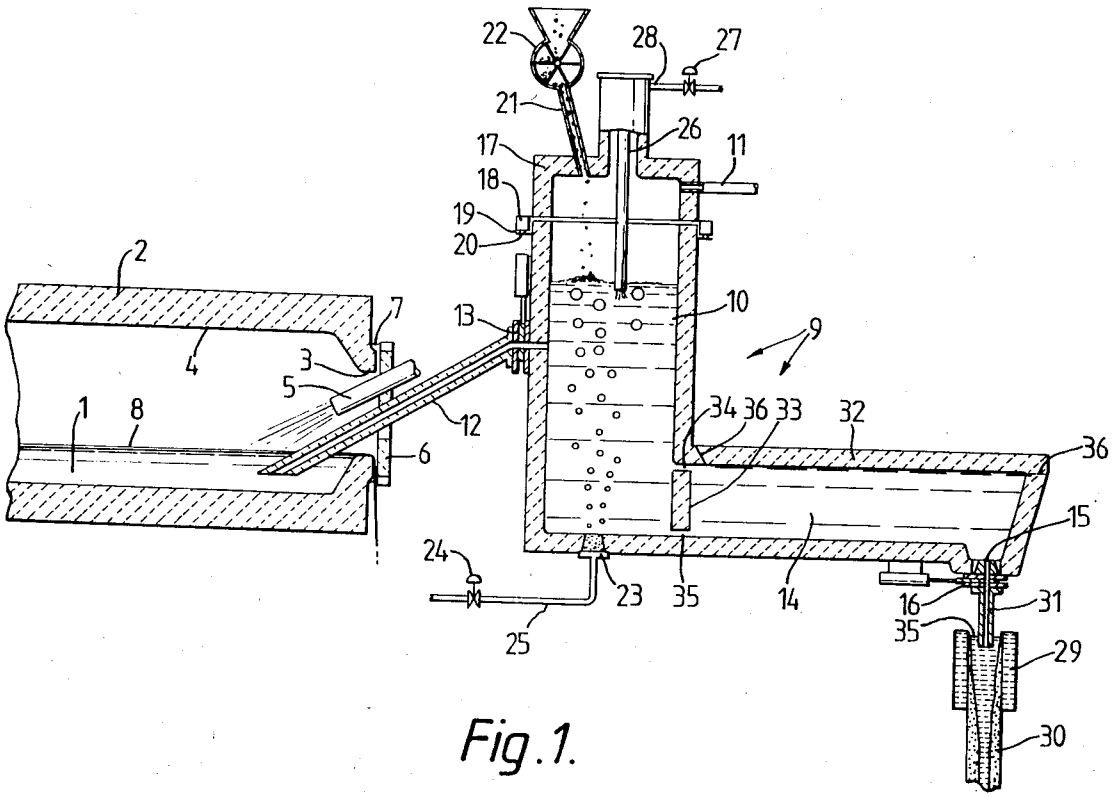

The invention relates to the technology of steelmaking and, more particularly, to an improved method and apparatus for continuous vacuum degassing and casting of molten steel.

My U.S. Pat. No. 3,514,280 describes continuous metal melting, withdrawal and discharge from a metal bath maintained within a rotary furnace emplying a siphon tube leading to an external chamber maintained under a negative pressure controlled in such a manner as to regulate the rate of metal discharge via the chamber. Further, my U.S. patent application Ser. No. 351,669 discloses a process for highly energy-efficient charge preheating, steelmaking, withdrawal and casting on a continuous basis, incorporating a more sophisticated vacuum withdrawal and post-treatment system for the molten steel for casting.

Because of its high temperature and singular chemical and physical properties in the molten condition, steel poses a unique combination of processing problems which have not been fully overcome by the above or other prior art techniques.

Effective steel degassing requires very high vacuum levels, that is, virtually complete evacuation, in combination with large exposed surface area-to-volume ratio, and it is an object of the present invention to most efficiently provide for initiating and maintaining of consistently high vacuum levels in the degassing operation.

Any exposure to air or oxygen adversely affects steel cleanliness and control of composition, and another object is to eliminate or minimize metal exposure to atmosphere during and following discharge from the furnace.

The high temperature and chemically active nature of molten steel erodes the refractory interiors of containing vessels, ducts, valves, etc. resulting in gradual and progressive changes of dimensions during operation and it is a further object of the present invention to eliminate any significant effect of these occurrences on process control parameters.

Small passages, valves and flow adjustment devices can be subject to plugging by localized metal freezing and also by characteristic gradual build-ups of agglomerated non-metallic inclusion material from within the metal, as well as mechanical problems, and still another object is to reduce to a maximum of one the number of such flow restrictions in the molten metal sequence of movement after leaving the molten furnace bath.

Furthermore, to start operation, the methods previously described utilize a secondary shut-off and seal ahead of, and in addition to, the casting gate or throttling valve, as necessary to provide for an initial starting vacuum and filling of the withdrawal apparatus with metal, and it is a still further object to eliminate the need for this secondary shut-off and seal.

The key element of the present invention is the closure and sealing of casting pool tundish from the outside atmosphere. This is provided in combination with sufficient degassing chamber height to accomodate molten metal column with a one-atmosphere ferrostatic head of metal above the highest furnace level, and elimination of flow limiting or controlling size restrictions of the furnace-to-vessel passage or vessel-to-tundish passage, to realize a more effective, simple and trouble-free system. At start-up, a gate valve (or valves) at the casting outlet(s) seal the system, allowing drawing of initial vacuum and fill-up with metal, and then the casting outlet(s) act as the only control point during operation. The absence of other flow restriction renders any dimensional change in other parts of the system from erosion or thermal effects essentially irrelevant to the end operating result.

The method of the present invention thus incorporates methods for continuous vacuum processing and casting of molten steel and other metals in which a molten metal column is maintained with its top surface under vacuum in a continuous post-treatment vessel located adjacent to a continually replenished molten metal bath, with the column having a barometric height above the bath corresponding to the differential between prevailing atmospheric pressure on the bath surface and the vacuum pressure, and the column is fed with metal from the bath by way a tube with the inlet end inserted below and withdrawing metal from beneath the surface of the bath and the outlet directed into the column, and which includes a lateral extension of the lower portion of said column forming a pouring pool confined within a tundish chamber equipped with at least one nozzle outlet for pouring of metal at a level below the surface level of the molten bath; and in combination with these features introduces the step of sealing of the pouring pool apart from the outside atmosphere, thus substantially preventing any contact of the molten metal with the atmosphere during metal passage from within said bath, through said tube, column and pouring pool, at least until passage of molten metal through the nozzle outlet.

Under these conditions, because the top of the tundish is closed and sealed, the top level of metal therein does not affect the pressure at the nozzle inlet. For a given molten metal, with no flow restriction in the withdrawal tube or post-treatment vessel which is small enough to cause a significant frictional pressure loss from metal flow, the overall rate of metal flow is substantially governed only by the size and characteristics of the nozzle and the ferrostatic head of of metal corresponding to the difference in metal level between the surface of the molten metal bath and the inlet to the nozzle. As the molten bath surface is the only surface controlled at reference atmospheric pressure, the degassing column height or magnitude of the vacuum also do not directly influence the pressure at the nozzle.

A complete vacuum maintained over the column surface facilitates effective metal degassing and maintains a column with a constant differential of approximately $4\frac{1}{2}$ feet in height above the metal bath surface.

In combination with a complete closure for the tundish nozzle outlet opening, the method also provides a new and convenient means for creating initial vacuum and starting flow, by closing the nozzle opening with the effect of substantially sealing the tundish and vacuum chamber when in the preoperational non-filled condition; evacuating the tundish and vacuum chamber to effect molten metal flow by movement from said bath through the tube into the degassing chamber and progressive filling of the chamber and tundish with molten metal up to the barometric height of the column; and then removing the closure from the nozzle outlet to allow metal discharge to begin and thereby establish the conditions of continuous vacuum degassing and pouring.

Also according to the method of the invention, the metal may be introduced directly into a vertical continuous casting mold of a continuous casting machine. The transfer passage may be sealed, extending the sealed metal path excluded from the atmosphere all the way from furnace-to-mold or even furnace-to-solidified casting in horizontal machines or covered-mold vertical (including curved mold) machines. The withdrawal speed of the solidified casting from the casting machine is inherently the sole external control of molten metal flow rate in completely closed systems such as most horizontal casters, and this control also includes vertical (or curved mold) casters equipped with automatic tundish-to-mold level control, as now are prevalent in the art of continuous casting.

The invention also provides an apparatus for conducting the method comprising a continuous post-treatment vessel incorporating an enclosed vacuum degassing column chamber section, a metal withdrawal tube and a laterally extending tundish pouring section, the latter incorporating at least one nozzle outlet for molten metal and equipped with an enclosed and sealed cover in combination with the above. According to one embodiment, the nozzle outlet is directed into a vertical (or curved) continuous casting machine mold, the nozzle opening being automatically regulated by closed-loop control maintaining a constant mold metal level. In another embodiment, discharge is direct from the tundish into a horizontal continuous casting mold, whereby there is not any molten metal exposure to atmosphere all the way from furnace to solidification, and the metal flow rate from the furnace through the withdrawal and degassing system is established solely by adjustments to the rate of withdrawing the solidified metal casting.

Prior post-treatment and handling systems in the art of ladle metallurgy, vacuum degassing and contuous casting include some form of external tundish level control and ladle flow control in open-shut or throttling mode, in which post-treatment vessels are filled and emptied and maintained by externally controlled devices. The present invention eliminates need for these additional external controls, as the new method and apparatus inherently maintains balanced flow rates from molten furnace bath-to-casting, which correspond to the rate of withdrawal of the solidified casting. It is therefore only necessary to balance the casting withdrawal speed with the molten metal supply in the bath.

Figure 2:
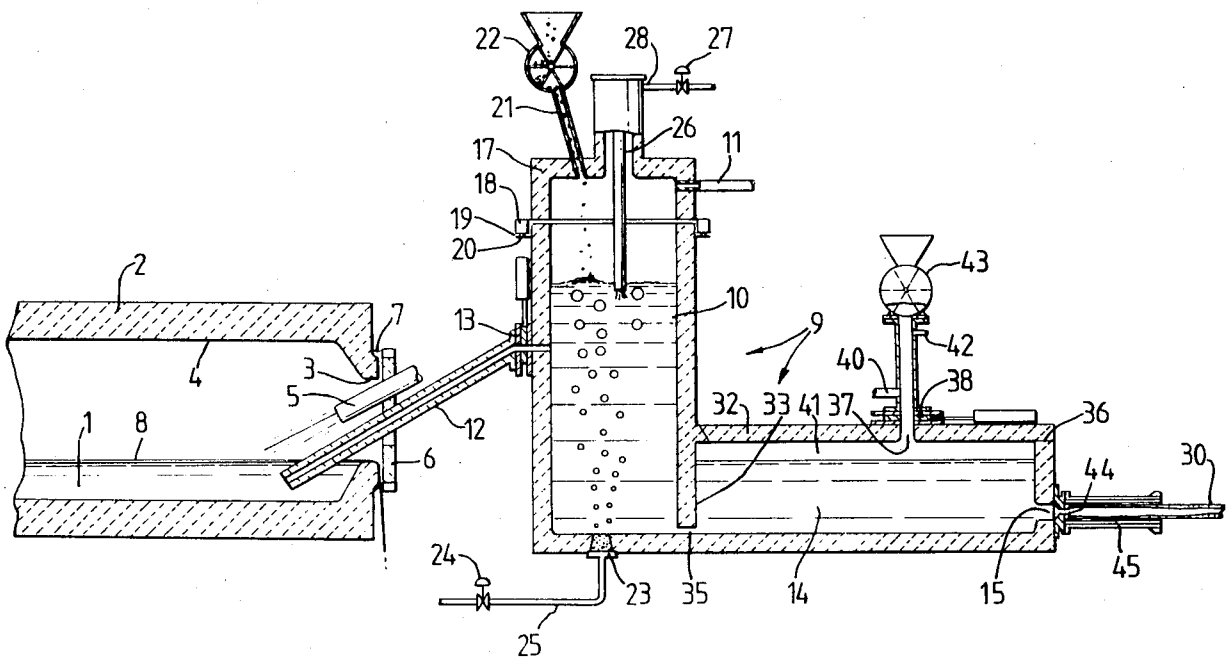

Various other objects, features and advantages of the method and apparatus of this invention will become apparent from the following detailed description and claims, and by referring to the accompanying drawing, of which FIG. 1 is a diagrammatic sectional view illustrating an embodiment of the method and apparatus of the invention featuring vertical continuous casting and having the tundish cover completely sealed from the atmosphere, and FIG. 2 is an alternative embodiment featuring horizontal continuous casting and providing for the option of exposing the tundish pool to atmospheric pressure, during continuous steady-state operation, after metal flow has been established.

Referring to FIG. 1, by way of example, a bath of molten metal 1 is maintained behind an annular dam restriction 3 of the discharge opening of a rotary furnace 2, which is lined with refractory material 4 and heated by burner 5 to maintain the metal in molten condition. In the embodiment illustrated, a stationary barrier 6 equipped with gas-container seals 7 acts to limit interchange of heat and gases between the outside atmosphere and the furnace interior. Slag 8 which floats on the metal may be discharged by overflowing the annular discharge opening.

The metal withdrawal and degassing apparatus comprises the continuous post-treatment vessel 9 which incorporates the vacuum degassing column chamber section 10, the top part of which is evacuated by way of vacuum connection 11 employing ejectors or a vacuum pump. The metal withdrawal tube 12 has its inlet end inserted down in molten bath, and the outlet connected into the degassing column chamber section 10 and can be equipped with a sliding shut-off valve 13. The internal duct of withdrawal tube 12 preferably has a large enough cross section to avoid significant frictional pressure drop through the range of operation flow rates (excepting initial filling), whereby changes occurring in this cross-section, for example, through erosion by molten metal, do not have any significant influence on the operation. A pouring tundish chamber section 14 projects laterally out from the lower portion of the column chamber section 10, and contains at least one pouring nozzle outlet 15 which is equipped with a slide-gate valve 16 for opening and closing to interupt flow of metals or gases through the nozzle.

The degassing column chamber section 10 most conveniently has a removable cover 17 to facilitate access and refractory repair, which is sealed, for example, by a water-cooled ring 18 carrying a circular seal 19 resting on sealing flange 20 extending around the degassing column chamber circumferences. Feeding of alloys and reagents into the degassing column is accomplished via a sealed conduit 21, and a sealed rotary gate valve 22 or, alternatively, a two-chamber vacuum lock, is employed to maintain a vacuum seal during transfer of the additive materials. A porous refractory plug 23 supplied with stirring gas via valve 24 and pipe 25 may be included to assist in stirring and degassing of the column metal. An injection lance 26, which may be water-cooled, may be included, and supplied with oxygen, carrier gas and additives by way of valve 27 and tube 28. These expedients are all well-known, per se, in the art of ladle metallurgy.

The pouring tundish chamber section 14 incorporates a top cover 32 which is sealed against the atmosphere during start-up and operation. The cover preferably is removable to facilitate refractory repair and replacement, and the cover perimeter 36 is sealed with refractory mortar and/or a sealing compound during placement prior to operation. Although various such sealing materials are adequate, a supplementary seal may also be provided, for example, by a water-cooled ring and seal pressed against a sealing flange, in a manner similar to that for column section cover 17. A refractory wall barrier 33 may be incorporated into the assembly to restrict free mixing of molten metal between vacuum degassing column chamber section 10 and tundish chamber section 14. The required metal transfer passages 34,35 can have a very small cross section relative to the junction area between column and tundish sections to substantially prevent short circuiting of inadequately reacted and non-degassed metal from the degassing column section 10 into the pouring tundish section 14, although not so small so as to result in a significant frictional flow pressure drop.

It will be evident that by closure of the top transfer opening 34 when vessel filling flow is established, that the tundish top seal could be opened and the tundish subsequently operated in the normal manner, with atmospheric pressure maintaining the tundish metal surface at approximately the same level as the bath surface. This procedure, however, introduces the mechanical requirement for a blocking gate or equivalent for top passage 34, and exposes the surface of the tundish pool to atmosphere. A possible advantage is ease of adding reagents such as deoxidizers into the tundish pool via an opening in the tundish roof.

In the FIG. 1 embodiment, the pouring nozzle outlet 15 from the tundish discharges directly into a vertical water-cooled mold 29 of a vertical (or curved) continuous casting machine, from which the partially solidified casting 30 is typically withdrawn by a withdrawal mechanism having an adjustable and controlled withdrawal speed which is located below and beyond a water-cooled spray chamber adapted to complete the metal solidification process. The stream from tundish-to-mold is separated from the atmosphere by a ceramic shroud 31.

FIG. 2 shows an alternative embodiment including a tundish cover aperture 37 equipped with another slide-gate valve 38 for making and breaking the tundish cover seal. The top metal passage 34 from column-to-tundish has been eliminated, leaving only passage 35 which is fully at a level lower than the surface of molten bath 1, whereby operation can be initiated simply by closing of shut-off valve 13 prior to start-up, followed by near complete evacuation of the continuous post-treatment vessel before re-opening valve 13 to effect filling of the vessel. After filling with molten metal, the tundish cover aperture 27 could be opened and operate subsequently with the ambient air or artificial atmosphere above the metal surface. In the absence of significant frictional pressure losses from molten metal flow through withdrawal tube 12 or passage 35, the top surface of the metal in pouring tundish chamber 14 then would coincide with the surface level of molten bath 1.

FIG. 2 also shows a tundish-pool shrouding arrangement whereby low-pressure inert or reducing gas such as argon is introduced at inlet 40 to fill tube 39 and the space 41 over the tundish pouring pool, utilizing restricted exit 42 to maintain slight positive pressure and exclude the surrounding air. Rotary valve 43 is illustrated as an example of a method of introducing reagents into the tundish. Continuously fed wire, as well known in the art, is another obvious alternative for adding materials. Should substantial quantities of slag-forming constituents be necessary for metallurgical reasons, a slag-spout sealed by a temporary barrier (not shown) would also be indicated.

FIG. 2 also illustrates diagrammatically the connection into a horizontal continuous caster. Tundish nozzle outlet 15 leads directly into break-ring 44 forming the inlet to water-cooled mold 45, the metal path at the tundish-mold junction being entirely separated from contact with the surrounding atmosphere. The embodiment shown effects the necessary seal for initial post-treatment vessel evacuation and filling by means of sealing the clearance between the dummy bar head and the inner mold walls at the outset. Horizontal casters also have included a slide-gate valve between the tundish nozzle outlet and the break ring (not illustrated), which would provide a primary closure and seal, the dummy bar then being a secondary one.

As a general exemplary description of the operation, the continuous post-treatment vessel assembly as in FIG. 1 is prepared and moved into position with the withdrawal tube inserted into the furnace and both tube slide-gate 13 and nozzle slide-gate valve 16 closed, and a vacuum is created through vacuum line 11. With the inlet of withdrawal tube 12 submerged in bath 1, slide-gate 13 is opened, drawing the metal in to progressively fill the tundish chamber section 10 and then the column chamber section 11, up to the barometric height above bath 1, according to the vacuum pressure effected. The slide-gate 16 is opened allowing flow from tundish to mold by way of pouring nozzle outlet 15. This procedure forms and establishes a continuous sealed flow-path of molten metal within the post-treatment vessel 9 extending from within the furnace bath 1 all the way through to the nozzle outlet 15, and hence into the continuous casting mold.

It is evident that by incorporating throttling action into slide gate valve 16 with a sensor-control circuit between metal meniscus level 35 and the throttling valve, flow through the nozzle 15 will be automatically balanced with the solidified casting withdrawal speed, the latter thus being the sole control of the overall metal throughout rate through the continuous post-treatment vessel 9. Details are not illustrated but are well known in the art of vertical and curved mold continuous casting. In horizontal casting, as in FIG. 2, the metal passage from nozzle-to-mold is essentially closed and full of metal and sealed, inherently without freedom for a variable metal level in the mold, yielding a direct-acting mechanical cause-and-effect relationship between the solidified metal withdrawal motion and flow through the tundish nozzle and break-ring into the mold.

It will be appreciated that preferred embodiments of an improved method and apparatus for continuous vacuum degassing and casting of steel and other metals have been described and illustrated and that variations and modifications may be made by persons skilled in the art, without departing from the scope of the invention defined in the appended claims.

I claim:

1. In a method for continuous vacuum processing and casting of molten steel and other metals in which a molten metal column is maintained with its top surface under vacuum in a continuous post-treatment vessel located adjacent to a continually replenished molten metal bath, and said column is fed with metal from said bath by way of a withdrawal tube with the inlet end inserted below and withdrawing metal from beneath the surface of said bath and the outlet directing the metal into said column, with a lateral extension of the lower portion of said column forming a pouring pool confined within a tundish chamber section equipped with at least one nozzle outlet for pouring of metal at a level below the surface level of said molten bath; the combination thereof with: sealing of said pouring pool apart from the outside atmosphere thus substantially preventing any contact of the molten metal with the atmosphere during metal passage from within said bath, through said tube, column and pouring pool, at least until passage of molten metal through said nozzle outlet.

2. A method according to claim 1 in which said column has a barometric height above the bath substantially corresponding to the differential between prevailing atmospheric pressure on the surface of said bath and the magnitude of said vacuum and in which the ferrostatic pressure at the inlet to said nozzle outlet is substantially equivalent to the ferrostatic head of metal corresponding to the difference in metal level between the surface of said molten metal bath and said inlet to said nozzle.

3. A method according to claim 2 including throttling of the cross section size of said nozzle outlet adapted to adjust and control the rate of metal flow therethrough, whereby the overall rate of metal flow from said bath through said degassing chamber and tundish essentially depends only upon the size of said nozzle.

4. A method according to claim 1 in which the top surface of said column is maintained under a nearly complete vacuum with a pressure less than 1 percent of one atmosphere, and the column barometric height thereby substantially corresponds to a one-atmosphere ferrostatic head, amounting to approximately a steel column height of 4½ feet above the surface of said molten bath.

5. In a method for continuous vacuum processing and casting of molten steel and other metals, in which a molten metal column is maintained with its top surface under vacuum in a continuous post-treatment vessel located adjacent to a continually replenished molten metal bath, and said column is fed with metal from said bath by way of a withdrawal tube with the inlet end inserted below and withdrawing metal from beneath the surface of said bath and the outlet directing the metal into said column, with a lateral extension of the lower portion of said column forming a pouring pool confined within a tundish chamber equipped with at least one nozzle outlet for pouring of metal at a level below the surface level of said molten bath; the combination thereof with sealing of said pouring pool apart from outside atmosphere and maintaining this seal during operation, thus substantially preventing any contact of the molten metal with the atmosphere during passage from within said bath as the metal passes through said tube, column and pouring pool, at least until passage of molten metal through said nozzle outlet; and introducing the molten metal via said nozzle outlet directly into a continuous casting mold within which at least the outer surface of the metal solidifies and from which the metal exits at a rate governed by external adjustment of the withdrawal speed of the solidified casting.

6. A method according to claim 5 including the step of enclosing the flow path leading from said nozzle into said mold whereby the metal is sealed away from contact with the atmosphere throughout the entire flow path extending from within said molten bath, through said column pouring pool and nozzle outlet up to entry into said mold.

7. A method according to claim 5 wherein said metal pours from said nozzle into a vertically arranged continuous casting mold and which also includes automatic level control by means adapted for regulating the molten metal flow through said nozzle outlet which automatically maintains a substantially constant metal surface level in said mold throughout the range of variation of said withdrawal speed of the solidified casting; and in which said column has a barometric height above the bath substantially corresponding to the differential between prevailing atmospheric pressure on the surface of said bath and the magnitude of said vacuum and in which the ferrostaic pressure at the inlet to said nozzle outlet is substantially exquivalent to the ferrostatic head of metal corresponding to the difference in metal level between the surface of said molten metal bath and said inlet to said nozzle; also including the step of externally controlling the withdrawal speed of the solidified casting from said mold, whereby said withdrawal speed is the sole external operating adjustment and the primary means of controlling the overall rate of molten metal passage between said molten bath and said casting mold.

8. A method according to claim 5 wherein said molten metal exits from said tundish pouring pool by way of a nozzle outlet directed horizontally from said pool entering directly into a horizontally-oriented mold section of a horizontal continuous casting machine having the mold inlet and entering metal passage substantially sealed and separated from the atmosphere, whereby the metal is substantially sealed away from contact with the atmosphere throughout the entire flow path extending from within said molten metal bath through said column, pouring pool, nozzle outlet and casting mold up to the exit from said mold and exposure of solidified metal to atmosphere following exit; and in which said column has a barometric height above the bath substantially corresponding to the differential between prevailing atmospheric pressure on the surface of said bath and the magnitude of said vacuum and in which inlet to said nozzle outlet is substantially equivalent to the ferrostatic head of metal corresponding to the difference in metal level between the surface of said molten metal bath and said inlet to said nozzle; also including the step of externally controlling the withdrawal speed of the solidified casting from said mold, whereby said withdrawal speed is the sole external operating adjustment and the primary means of controlling the overall rate of molten metal passage between said molten bath and said continuous casting mold.

9. In a method for continuous vacuum processing and casting of molten steel and other metals in which a molten metal column is maintained with its top surface under vacuum in a continuous post-treatment vessel located adjacent to a continually replenished molten metal bath, and said column is fed with metal from said bath by way of a withdrawal tube with the inlet end inserted below and withdrawing metal from beneath the surface of said bath and the outlet directing the metal into said column, with a lateral extension of the lower portion of said column forming a pouring pool confined wihtin a tundish chamber section equipped with at least one nozzle outlet for pouring of metal at a level below the surface level of said molten bath; the combination thereof with the additional steps preceding the above substantially steady-state conditions, to start initial flow, comprising: sealing of the cover of the tundish chamber against the outside atmosphere; closing said nozzle opening with the effect of substantially sealing said tundish and vacuum chamber when in the pre-operational nonfilled condition; evacuating said tundish and vacuum chamber to effect molten metal flow by movement from said bath through said tube into said degassing chamber and progressive filling of said chamber and tundish with molten metal up to said barometric height of said column; and removing the closure from said nozzle outlet to allow metal discharge to begin and thereby establish the conditions of continuous vacuum degassing and pouring.

10. In a method for continuous vacuum processing and casting of molten steel and other metals in which a molten metal column is maintained with its top surface under vacuum in a continuous post treatment vessel located adjacent to a continually replenished molten metal bath, and said column is fed with metal from said bath by way of a withdrawal tube with the inlet end inserted below and withdrawing metal from beneath the surface of said bath and the outlet directing the metal into said column, with a lateral extension of the lower portion of said column forming a pouring pool confined within a tundish chamber section equipped with at least one nozzle outlet for pouring of metal at a level below the surface level of said molten bath; the combination thereof with the additional steps preceding the above substantially steady-state conditions to start initial flow, comprising: sealing of the cover of the tundish chamber against the outside atmosphere; effecting closure and sealing of the metal passage through said withdrawal tube; closing said nozzle opening with the effect of substantially sealing said tundish and vacuum chamber when in the pre-operational non-filled condition; evacuating said tundish and vacuum chamber; opening of said metal passage closure through said wihtdrawal tube to effect molten metal flow by movement from said bath through said tube into said degassing chamber and progressive filling of said chamber and tundish with molten metal up to said barometric height of said column; and removing the closure from said nozzle outlet to allow metal discharge to begin and thereby establish the conditions of continuous vacuum degassing and pouring.

11. A method according to claim 10 in which all of the passageway between the lower position of said column and said tundish pool is at an elevation lower than the surface of said metal bath and which includes the additional step of opening said seal of the tundish cover and carrying out the subsequent operation under substantially steady-state conditions but with the surface of said pouring pool in the tundish section exposed to atmospheric pressure.

12. A method according to claim 11 in which the metal surface level of said tundish pouring pool and the surface level of said molten metal bath essentially correspond, under said steady-state conditions, that is, there is not any significant flow frictional pressure loss during passage through said post-treatment vessel between said molten metal bath and said nozzle, and said column has a barometric height above the bath substantially corresponding to the differential between prevailing atmospheric pressure on the surface of said bath and the magnitude of said vacuum and in which the ferrostatic pressure at the inlet to said nozzle outlet is substantially equivalent to the ferrostatic head of metal corresponding to the difference in metal level between the surface of said molten metal bath and said inlet to said nozzle.

13. In an apparatus for continuous vacuum degassing and pouring of molten steel and other metals from a continually replenished molten metal bath, comprising a continuous post-treatment vessel stationed adjacent to said molten metal bath incorporating a vacuum degassing column section with an evacuated top space maintained over a columnar enclosure for molten metal extending upwards above the level of said molten metal bath and incorporating a metal withdrawal tube with the inlet inserted beneath the surface of said bath and the outlet connected into said degassing column section, the lower portion of which is in direct communication with a laterally extending pouring tundish section incorporating at least one pouring nozzle outlet situated below the surface level of said metal bath; the combination thereof with: an enclosed and sealed cover over said tundish section adapted to exclude the outside atmosphere and prevent communication between the interior of said tundish section and the outside atmosphere during evacuation of said post-treatment vessel and the course of metal passage through said pouring tundish section to said discharge nozzle outlet; and sealed opening and closure means for said pouring nozzle outlet adapted to facilitate evacuation of said tundish chamber section when closed and flow of molten metal therethrough when opened.

14. An apparatus according to claim 13 which also includes closure for said nozzle outlet adapted to complete the sealing of said post-treatment vessel when in the unfilled condition to facilitate initial evacuation of said vessel to effect initial filling with molten metal by way of said withdrawal tube at the start of operation.

15. An apparatus according to claim 13 which also includes a separating barrier adapted to limit free movement of molten metal between said vacuum column section and said pouring tundish section, said barrier covering the major portion of the tundish pool entry cross section, with at least one passageway therethrough including a passageway located at a level proximate the surface level of said molten metal bath.

16. An apparatus according to claim 13 in which at least one nozzle outlet is adapted for discharging downwardly and which also includes a continuous casting machine with a vertically-oriented mold positioned under said nozzle outlet and means for sensing of metal level in the mold with means for feedback and automatic control by throttling of the metal stream through said nozzle outlet, which maintains a substantially constant metal level in the mold during casting; in combination with externally controlled variable speed withdrawal means below the mold adapted to withdraw the solidified casting at a selected and controlled rate, said rate of withdrawal thereby also solely and directly governing the overall rate of molten metal throughput from said molten bath through said continuous post-treatment vessel to said nozzle outlet, under conditions of constant vacuum pressure maintained in said evacuated top space of said vacuum degassing column section.

17. An apparatus according to claim 16 which also includes a sealing shroud extending from said nozzle outlet to an outlet location beneath said metal level in the mold, thus extending the metal path excluded from the atmosphere from the withdrawal tube inlet location in said molten bath all the way through said post treatment vessel and nozzle outlet to a location below said metal level within said mold.

18. An apparatus according to claim 13 in which at least one nozzle outlet is directed horizontally and which includes a horizontally disposed mold of a horizontal continuous casting machine connected directly into said nozzle via a sealed connection, thereby excluding the atmosphere from the molten metal also throughout metal passage from the nozzle outlet up to exposure of the solidified casting to the atmosphere following exit from said mold, and also including externally controlled variable speed withdrawal means adapted to withdraw the solidified casting at a selected and controlled rate, said rate of withdrawal thereby also solely and directly governing the overall rate of molten metal throughput from said molten bath through said continuous post-treatment vessel to said nozzle outlet, under conditions of constant vacuum pressure maintained in said evacuated top space of said vacuum degassing section.

19. In an apparatus for continuous vacuum degassing and pouring of molten steel and other metals from a continually replenished molten metal bath, comprising a continuous post-treatment vessel stationed adjacent to said molten metal bath incorporating a vacuum degassing column section with an evacuated top space maintained over a columnar enclosure for molten metal extending upwards above the level of said molten metal bath and incorporating a metal withdrawal tube with the inlet inserted beneath the surface of said molten bath and the outlet connected into said degassing column section, the lower portion of which is in direct communication with a laterally extending pouring tundish section incorporating at least one pouring nozzle outlet situated below the surface level of said metal bath; the combination thereof with: an enclosed and sealed cover over said tundish section adapted to exclude the outside atmosphere and prevent communication between the interior of said tundish section and the outside atmosphere during evacuation of said post-treatment vessel; a tundish cover aperture with sealed opening and closure means in said cover above the surface level of said molten bath adapted to allow opening of said tundish to atmospheric pressure following filling of said post-treatment vessel with molten metal; a sealed opening and closure means for said withdrawal tube; and a separating barrier adapted to limit free movement of molten metal between said vacuum column section and said pouring tundish section, said barrier completely covering the tundish chamber entry cross section to a level extending essentially below the surface level of said molten metal bath; and sealed opening and closure means for said pouring nozzle outlet adapted to facilitate evacuation of said tundish chamber section when closed and flow of molten metal therethrough when opened.

20. An apparatus according to claim 19 which also includes shrouding gas supply means for said tundish cover aperture for said pouring tundish section.

* * * * *